United States Patent [19]

Biss

[11] 4,024,025

[45] May 17, 1977

[54] GAS CLEANING DEVICE FOR CONTROLLING AIR POLLUTION FROM THE CHARGING PORTS OF A BY-PRODUCT COKE OVEN AND FOR OBTAINING SUPERIOR QUALITY BY-PRODUCTS

[76] Inventor: A. Albert Biss, 1511 Atlas Road, Wheeling, W. Va. 26003

[22] Filed: Mar. 26, 1975

[21] Appl. No.: 562,254

Related U.S. Application Data

[63] Continuation-in-part of Ser. No. 414,513, Nov. 9, 1973, abandoned.

[52] U.S. Cl. ..... 202/263; 261/126; 239/433

[51] Int. Cl.[2] ..... C10B 27/04

[58] Field of Search ..... 196/136; 202/254–260, 202/269, 263; 239/433; 261/126

[56] References Cited

UNITED STATES PATENTS

| | | | |
|---|---|---|---|
| 1,747,610 | 2/1930 | Alkerea | 202/254 |
| 1,920,801 | 8/1933 | Miller | 202/254 |
| 2,218,916 | 10/1940 | Koppers | 202/255 |
| 2,387,345 | 10/1945 | Pearl | 261/126 |
| 2,529,045 | 11/1950 | Ortgies | 261/126 |
| 3,605,386 | 9/1971 | Erwin | 261/126 |
| 3,764,482 | 10/1973 | Yoshida | 201/40 |
| 3,804,721 | 10/1940 | Koppers | 202/255 |

*Primary Examiner*—Hiram M. Bernstein

[57] ABSTRACT

This invention relates principally to a method and device for controlling particulate-ladened smoke and gas emissions from the charging ports of a by-product coke oven. This device will clean the coarse particulate matter from the by-product gases resulting from the coal carbonization process thereby permitting higher steam aspiration pressures in the oven off-take pipe which is required to create sufficient negative pressure in the oven chamber and thus prevent the escape of smoke and gas to the atmosphere from the charging ports during the charging of the coal into the oven. This device can be installed on any conventional by-product coke oven by making certain modifications to the oven off-take piping.

3 Claims, 4 Drawing Figures

GAS CLEANING DEVICE FOR CONTROLLING AIR POLLUTION FROM THE CHARGING PORTS OF A BY-PRODUCT COKE OVEN AND FOR OBTAINING SUPERIOR QUALITY BY-PRODUCTS

CROSS-REFERENCE TO RELATED APPLICATION

This is a continuation-in-part of Application Ser. No. 414,513 filed Nov. 9, 1973, and now abandoned.

BACKGROUND OF THE INVENTION

At present, the common method used for collecting the by-product gases is to seal-off all the oven openings except for the off-take pipe. The gases then must flow from the oven through the off-take pipe and thence to the collection main which discharges to a decanter tank in the by-product processing plant. During the charging operation, however, the charging ports on top of the oven must be uncovered to admit coal into the oven. As the coal drops into the oven, voluminous clouds of smoke escape from the charging ports to the atmosphere thereby causing a serious air pollution problem.

Various attempts have been made by coke oven operators to control smoke emissions during oven charging operations, one means being to impose a negative pressure on the oven by steam aspiration in the off-take pipe. When the steam pressure and steam flow through the aspiration nozzle are increased to produce a sufficient negative pressure in the oven as required to draw the smoke into the off-take pipe, however, several problems are encountered:

1. Greater quantities of particulate matter are also drawn into the off-take pipe thereby exceeding the allowable limits for quinolin insolubles in the by-products,
2. Much of this particulate matter being large and dense as compared to the particles normally collected during the carbonization period, settle in the collecting main thus requiring more frequent cleaning or "spooning of the main",
3. The increased smoke and gas flow through the off-take pipe results in higher operating temperatures in the off-take pipe causing the off-take piping, valves, and other component parts of the gas collection system to warp and bind, thereby resulting in numerous leaks and other maintenance problems.

Because of these problems, the steam pressure and flow through the aspiration nozzle must be greatly reduced or even not used at all during the oven charging operation thereby causing considerable quantities of smoke and gas to escape from the charging ports and thus, to contaminate the atmosphere.

Referring to the drawing of FIG. 1, the common means presently employed for collection of the off-gases from a by-product coke oven is through the vertical off-take pipe sections 1, 2, and 3 which convey the gases to a collection main. The vertical ascension sections 1 and 2 as well as the gooseneck section 3 are lined with firebrick 5 which provides thermal protection from the hot gases 6 being discharged from the oven 4. In addition, a heat shield 7 around the lower ascension pipe is commonly employed to protect workmen from radiated heat and to prevent accidental contact with the hot surface of the ascension pipe.

The operating phase performed in filling the coke oven with coal is commonly referred to as "charging the oven". An oven normally has three or four charging holes or ports located in the top of the oven which is the roof of the oven. A larry car having a like number of coal hoppers travels on rail across the top of the oven and is positioned above the oven to be charged so that the coal hoppers are aligned with the charging ports. Before the coal is dropped into the oven, a workman opens a steam valve which allows steam to flow through the aspirator nozzle 9. The high velocity of the steam flow 8 aspirates the hot gases from the ascension pipe thereby imposing a negative pressure on the oven. The hot gases rising in the ascension pipe are discharged into the collection main where the gases are cooled and the particulate matter settles to the bottom of the main.

The amount of particulates present in the gas as it is drawn from the oven, varies directly as the steam pressure and flow through the aspiration nozzle. If the amount of quinolin insolubles in the off-gases becomes excessive, the tar compound also present in the gas, become overly contaminated making them unacceptable for further processing. In addition, the larger particle sizes which are drawn from the oven with increased gas flow, settle to the bottom of the collection main and clog the main thereby requiring more frequent spooning of the main. In order that both conditions may be avoided, the steam pressure must accordingly be reduced to lower levels such that the steam aspiration becomes ineffective as an air pollution control means and hence most of the smoke and gas generated in the oven during charging, escape from the oven to the atmosphere through the oven charging ports.

SUMMARY OF THE INVENTION

Therefore, among the objects of this invention is the prevention of atmospheric air pollution occuring during the charging period and the cleaning and cooling of the off-gases in order to obtain superior quality by-products and the elimination of excessive equipment maintenance.

In accordance with my invention, a portion of the existing off-take pipe is cut away to permit the insertion of a gas cleaning and cooling device consisting of a coned baffle and a liquid spray system which cause the coarse particulate matter to separate from the gas while, at the same time, the liquid cools the gas and the off-take pipe; and also consisting of a scrubbant disposal system which provides a means for separating the scrubbants of various consistencies collected during the various phases of the coke making process.

In a by-product coke oven having charging ports for filling the coke oven with coal and having a vertical off-take pipe for collecting off-gases and smoke from the oven, the off-take pipe having upper and lower sections and including an aspirator in the upper section for aspirating the off-gases from the oven, . . .

the improvement comprising an air pollution control device for cleaning the off-gases, the device adapted to permit sufficient aspiration pressure so that substantially all of the off-gases and smoke are drawn through the off-take pipe thereby preventing discharging of off-gases and smoke through the charging ports to the atmosphere, the device comprising a shroud disposed and contoured and adapted to fit over the lower section of the off-take pipe; a cone baffle having an outer surface sloping downwardly and outwardly beyond the lower section of the off-take pipe, the baffle is also spaced apart from and sloped corresponding to the shroud, the baffle positioned to deflect generally outwardly toward the shroud the off-gases and smoke coming from the oven upwardly through the lower section of the off-take pipe, the shroud contoured to deflect further the off-gases and smoke in a generally upward direction; a plurality of spray nozzles disposed below the aspirator and in adjacent space between the baffle and the shroud; the nozzles adapted to deliver liquid scrubbant in a pattern sufficient to distribute the liquid scrubbant on the outer surface of the cone baffle; and collector means for collecting the liquid scrubbant falling from the cone baffle, the collector means disposed about exterior portions of the lower portion of the off-take pipe and below the cone baffle and exterior piping for separating scubbants of different consistencies.

DESCRIPTION OF THE PREFERRED EMBODIMENT

The preferred embodiment of my invention is illustrated in the accompanying drawings in which . . .

Figure 2:
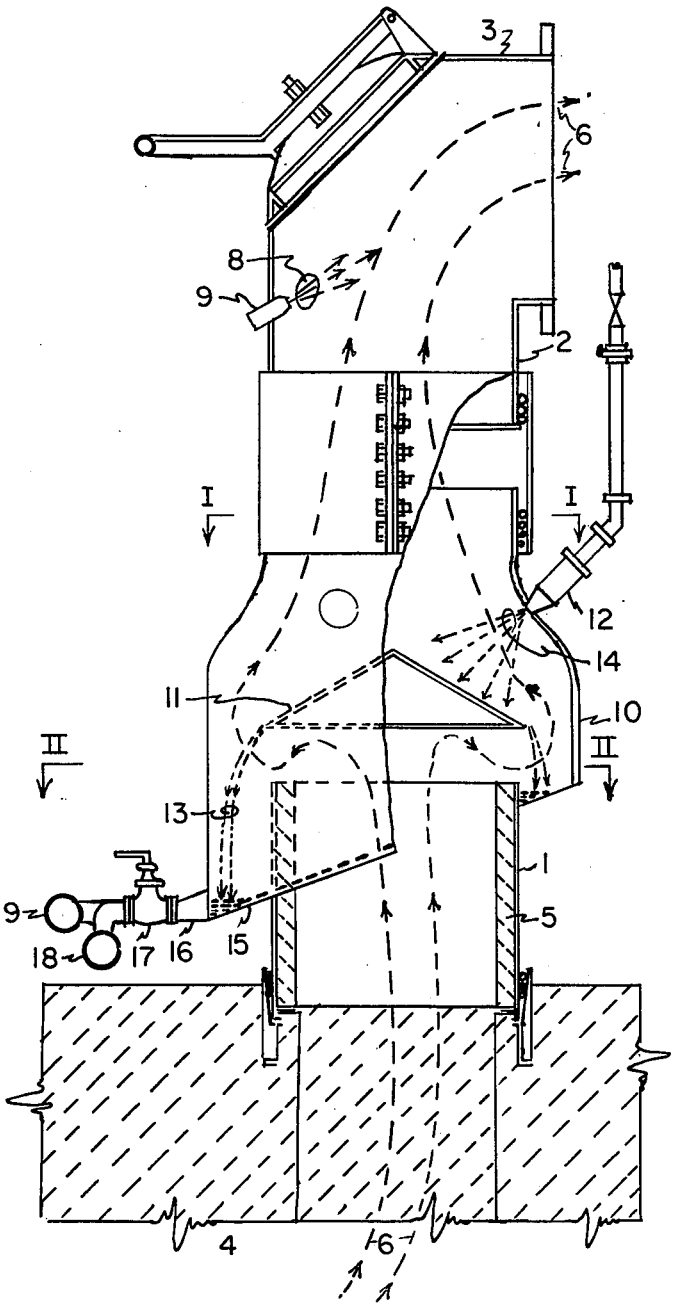
FIG. 2 is a vertical view of my gas cleaning device.

Referring to the drawing of FIG. 2, the lower ascension pipe is seen shortened to provide for the installation of the shroud 10, cone baffle 11, and the liquid spray nozzles 12. The hot gases rising in the ascension pipe are deflected by the coned baffle so that the gas stream reverses direction twice . . . first, downward passing through the liquid curtain wall 13, then reversing again in the upward direction rising into the gooseneck and thence to the collection main.

A feature of my invention is the design and configuration of the coned baffle and the shroud which force the gases to change direction, change speed and thereby causing the coarse particulate particles to drop from the gas stream. Referring to FIG. 2, the cone baffle is located sufficiently high above the lower off-take pipe so as not to impede the gas flow rising through the lower off-take pipe thereby minimizing the pressure drop incurred as the gases are deflected into a larger space between the shroud and the lower off-take pipe; this space being larger than the cross-sectional area of the lower off-take pipe, forces the gases to slow down; the base diameter of the cone baffle being sized corresponding to the shroud diameter so as to form a constriction between the cone baffle and the shroud, this constriction being a smaller area than the cross-sectional area of the lower off-take pipe, results in increased gas velocity through the constriction thereby forcing the heavier coarse particulate particles to drop from the gas stream; the diameter of the cone baffle base is thus made larger than that required to simply prevent liquid from entering the lower off-take pipe; above this constriction, the side of the cone baffle and the reducing section of the shroud are sloped in diverging directions so as to relieve back pressure and enhance the flow of gases upward into the steam aspiration stream. Thus, this means for changing the gas flow directions and gas velocities will cause the coarse particulate particles to separate and drop from the gas stream in the space between the lower off-take pipe and the shroud.

Figure 3:
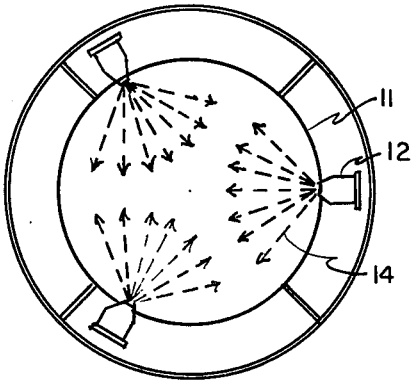
FIG. 3 is a plan sectional view taken on the line I — I of FIG. 2 which shows the configuration of the liquid spray nozzles.

Another feature of my invention is the means employed for producing a liquid spray and curtain wall through which the gases must pass thereby resulting in effectinve gas scrubbing and cooling. Referring to the drawing of FIG. 2, liquid spray nozzles are located below the steam aspirators and adjacent to the cone baffle, this location being the only workable position so as to prevent the liquid spray from being entrained into the steam aspiration stream 8, and so that the liquid can be uniformly distributed on the cone baffle. Referring to FIG. 3, one type of spray nozzles having flat elliptical orifices, are space equidistant around the shroud such that a uniform spray pattern of liquid is directed in a path approximately normal to the topside of the cone baffle. The liquid flows off the edge of the cone baffle producing a uniform liquid curtain wall through which the gases from the oven must pass countercurrently so as to effect a turbulent mixing of the liquid with the gas. The coarse particulate particles in the gas stream are thus wetted so as to further aid in separating the particles from the gas stream. Both the liquid spray and the liquid curtain wall also cool the gases thereby reducing the pressure of the gases which, in turn, increases the draft on the oven so as to further increase the velocity of the gases going through the constriction and through the upper off-take piping. Thus this means for wetting the coarse particulate particles, together with the means for changing gas flow directions and gas velocities described earlier, will cause the coarse particulate particles to effectively separate and drop from the gas stream in the space between the lower off-take pipe and the shroud.

Figure 4:
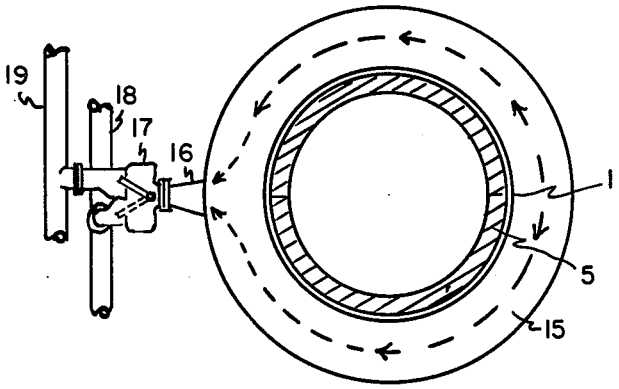
FIG. 4 is a plan sectional view taken of the line II — II of FIG. 2 which shows the drain trough around the ascension pipe and at the base of the shroud, the outlet pipe, the three position valve and the discharge piping.

A further feature is the method employed for accumulating and draining the waste liquid scrubbant such that the lower ascension pipe is cooled as well as being shielded. Referring to the drawing in FIG. 4, the trough 15 connects the shroud to the lower ascension pipe and provides the means for draining the waste liquid and particulates.

Another further feature is the method employed for separating the high and low particulate concentrations in the waste liquid. The outlet pipe 16 connects with a 3-position valve 17 such that the heavy ladened particulate liquid during charging may be diverted into a coarse particulate line 18 and the finer particulate ladened liquid during coking may be diverted into the fine particulate line 19.

During the coal charging operation and for as long as the steam is aspirating the gases from the oven, the valve 17 is opened to the coarse particulate line 18 which may be then discharged to a separate settling tank. After the steam aspiration is stopped, then the valve is turned to the alternate position which will allow the waste liquid to discharge into the fine particulate line from which it may be pumped into the collector main.

Figure 1:
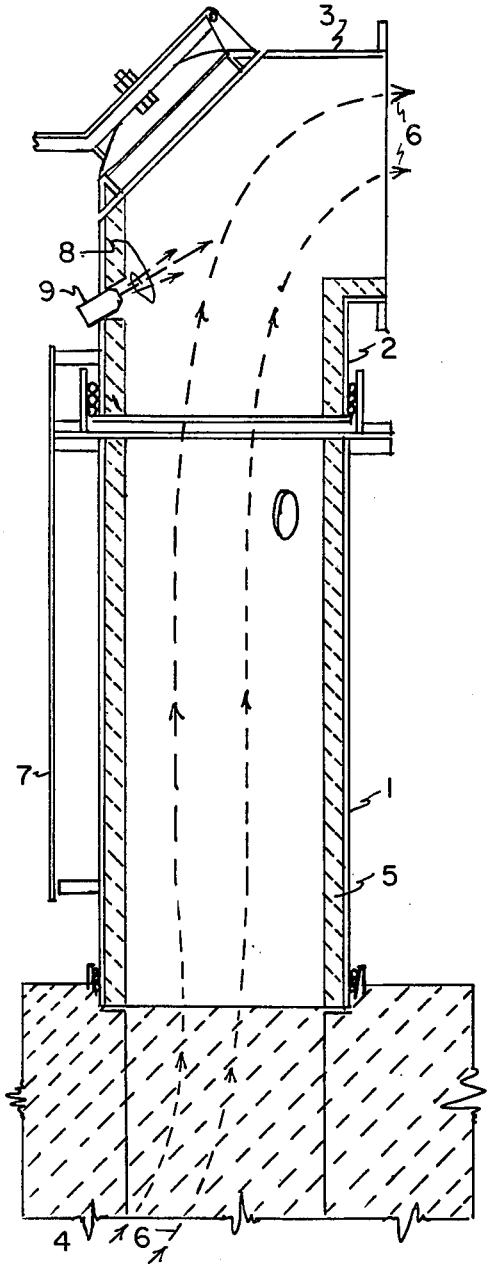

Referring again to the drawings of FIGS. 1 and 2, it can be seen that the firebrick which is commonly used to line the ascension and gooseneck piping sections is only needed in the lower pipe section in my invention as shown in the drawing of FIG. 2. In addition, the heat shield shown in the drawing of FIG. 1 is not needed in my invention since the liquid scrubbant will also cool the shroud and the ascension pipe shown in FIG. 2. Furthermore, since the shroud extends beyond the ascension pipe, it will deter workmen from accidently touching the ascension pipe.

Several significant design features make the present device different over the prior art including the inventions of S. P. Miller, U.S. Pat. No. 1,920,801, J. Van Ackeren, U.S. Pat. No. 1,747,610 and L. R. Forrest et al, U.S. Pat. No. 1,868,470. The elements in the present device are designed and arranged to physically clean the oven off-gases, primarily during the charging stage, whereas, in the prior art, the devices were intended to chemically distill the pickle liquor during the carbonization stage only. The present invention is useful in the preventing contamination of the oven by-products before they reach the gas main, whereas, the prior art devices refined the tar after it reached the main. With the present device, charging is done "on the main", e. i., with the main gas valve opened as is the current practice, whereas, in the prior art charging had been done "off the main," e. i., with the main gas valve closed as described in Van Ackeren, page 2, lines 40, 41, 42, and 43. Because of recently promulgated air pollution control regulations, however, the prior art of charging "off the main" is no longer permitted and, therefore, these prior art devices are no longer useful.

The location of the liquid spray nozzles in the present device is critical with respect to charging. The liquid spray nozzles are positioned below the steam aspiration nozzle, thus avoiding any interference between the liquid and the steam. In the prior art, however, the steam aspiration nozzle could not be used during charging as required in current practice since the liquor spray would become entrained with the steam and be carried into the gas main and, therefore, could not be used for scrubbing the off-gases during charging.

The location of the liquid spray nozzles in the present device is also critical with respect to scrubbing the off-gases. The liquid spray nozzles must be located near the cone baffle so as to direct a liquid spray pattern around the full circumference of the cone baffle in order to obtain a uniform liquid fall as required to effectively wet the particulate matter in the off-gases rapidly before the gases change direction and velocity thereby effecting the desired scrubbing action and fall-out of particulates. In the prior art, the liquor spray nozzle must be located at the top of the ascension pipe as described, to obtain as much time as is available for the liquor distillation process to take place throughout the length of the ascension pipe.

The liquid spray nozzle design in the present device is different over the prior art. In the present device, the nozzle must be designed to deliver a coarse flat spray pattern to properly flood the cone and to obtain a uniform liquid curtain fall off the cone. In the prior art, the nozzle must be designed to emit an atomized or fine spray as described in Miller page 2, lines 123, 124, 125 and 126 which is vaporized by the hotter off-gases obtained during carbonization, also, as described in Miller page 2, lines 141, 142, 143, 144, and 145 and, therefore, no effective wetting or scrubbing action of the off-gases can be obtained. In addition, the spray pattern must be circular to conform with the cross-section of the circular ascension pipe.

In the present device, two or more spray nozzles must be used to obtain a uniform liquid fall from the cone baffle, whereas, in the prior art, only one spray nozzle is used. In Miller page 5, lines 23, 24, and 25, the plural form of nozzles actually refers to only one nozzle in each of the three ascension pipes as shown at the bottom of FIG. 2. Similarly, in Van Ackeren, only one nozzle is shown in FIGS. 2 and 3, and on page 2, lines 54 and 55, only one nozzle 30, as well as only one nozzle port 32, are clearly described. Therefor, in the prior art, the nozzle is singular while in the present device, the nozzles are plural.

The design of the cone baffle in the present device is also different over the prior art. In the present device, the cone must be designed with the proper slope and diameter to obtain the proper deflection and velocity changes of the off-gases and to effect a uniform liquid fall through which the gases must pass, thereby obtaining the maximum pressure drop commensurate with the volume of off-gases, the available liquid scrubbant, the diameter of the shroud and the overall negative pressure imposed on the oven by steam aspiration during charging. In the prior art, the principle design feature is that the diameter must be large enough to simply prevent the liquor from falling into the coking chamber as described in Miller page 6, lines 7 and 8, and in Van Ackeren page 2, lines 57 and 58.

The L. R. Forrest device is similar to Miller and Van Ackeren, but no specific referencing has been included since it is not a part of the coke oven ascension pipe system.

I claim:

1. In a by-product coke oven having charging ports for filling the coke oven with coal and having a vertical off-take pipe for collecting off-gases and smoke from a coke oven, the oven off-take pipe having upper and lower sections and including a steam aspirator in the upper section for aspirating the off-gases from the oven the improvement comprising an air pollution control device for cleaning coarse particulate matter from the off-gases during the period when coal is being charged into the oven, the device adapted to permit sufficient aspiration pressure so that substantially all of the off-gases and smoke are drawn through the off-take pipe during the oven charging period thereby preventing the escape of off-gases and smoke through the charging ports to the atmosphere, the device comprising of a shroud, cone baffle, spray nozzles and scrubbant collection piping, and designed so as to charge the direction and velocity of the gases and wet the particulate matter, i.e., solid particles entrained in the gas, stream, so that the coarse particulate particles are separated and dropped from the gas stream before the gases are drawn upward into the upper section of the off-take piping by the action of the steam aspirator and thence discharged to the gas collection main; the lower part of the shroud is made sufficiently larger than the lower off-take pipe so that the area of the space between the shroud and the lower off-take pipe is larger than the cross-sectional area of the lower off-take pipe so as to allow the off-gases flowing upwardly from the lower off-take pipe to enter into the said larger shroud space and thus expand and reduce velocity; the base of the shroud, also being sloped so that the scrubbant liquid can effectively wash down the collected particulate matter; the upper part of the shroud being contoured so that the sides of the shroud and cone baffle are sloped in diverging directions so as to relieve the back pressure of the gas between the shroud and cone baffle, above the cone baffle and thus to increase the gas velocity and to produce a laminar flow of gases upwardly which will facilitate the aspiration of gas from the oven into the gas collection main during the oven charging period;

a cone baffle located sufficiently high above the lower off-take pipe so as to minimize gas pressure drop as the gases are deflected into the shroud area, the base diameter of the cone baffle being sized to form a smaller area or constriction between the cone baffle and the shroud than the area between the shroud and the lower off-take pipe so as to increase the gas velocity through the constriction and thence flowing upward, aided by the diverging slopes of the shroud and cone baffle; the cone baffle may be modified from that depicted in FIG. 2 depending on the overall height of the off-take piping providing, however, that the slope of the cone baffle diverges from the slope of the shroud and the cone baffle is high enough to confine the liquid spray on the side of the cone corresponding to the respective spray nozzle;

the liquid spray nozzles are located below and away from the steam aspirator so as to prevent the sprayed liquid from becoming entrained with the steam aspiration stream and thus being short circuited into the gas collection main; the spray nozzles being positioned near the cone baffle so as to direct the liquid uniformly distributed onto the cone baffle, said nozzles with flat elliptical orifices to produce a wide narrow spray pattern and the spray directed in a path normal to the surface of the cone so as to restrict the sprayed liquid to the cone surface, said nozzles also spaced equidistant around the cone baffle as required to evenly distribute the sprayed liquid around the cone baffle so as to produce a uniform liquid curtain fall between the cone baffle and the lower off-take pipe, such that the coarse particulate particles entrained in the gas stream are sufficiently wetted and forced to drop from the gas stream as the gas stream changes direction and velocity; the gases also passing through the upper sprays are further scrubbed of particulate matter;

thus, the shroud, cone baffle and spray nozzles working in conjunction with the steam aspirator, are a means for wetting the particulate matter and changing the direction and velocity of the gas stream so as to effectively scrub the coarse particulates from the oven off-gases during the oven charging period.

2. The device according to claim 1, comprised of spray nozzles, cone baffle, and shroud, as a means for producing a liquid curtain wall through which the oven off-gases pass so as to cool the gases and thus further reduce the back pressure thereby aiding the steam aspirator in creating a negative pressure in the oven during the oven charging period.

3. A device according to claim 1, wherein a three position valve connecting the collector means to two separate pipelines is a means for diverting the waste liquid scrubbant into either one of two disposal lines, one of which is intended for scrubbant high in content of insoluble particulate matter as occuring during an oven charging operation and the other disposal line which is intended for scrubbant low in content of insoluble particulate matter as occuring during a carbonization cycle.

* * * * *